US010980344B1

(12) United States Patent
Yang

(10) Patent No.: US 10,980,344 B1
(45) Date of Patent: Apr. 20, 2021

(54) SLIDING RAIL STRUCTURE FOR DRAWER OF LAYERED FRAME

(71) Applicant: MATTHEW COMFORT CO., LTD., Chunghua Hsien (TW)

(72) Inventor: Chieh-Hung Yang, Changhua Hsien (TW)

(73) Assignee: MATTHEW COMFORT CO., LTD., Changhua Hsien (TW)

( * ) Notice: Subject to any disclaimer, the term of this patent is extended or adjusted under 35 U.S.C. 154(b) by 0 days.

(21) Appl. No.: 16/888,648

(22) Filed: May 29, 2020

(51) Int. Cl.
*A47B 88/40* (2017.01)
*A47B 96/14* (2006.01)
*A47B 88/43* (2017.01)

(52) U.S. Cl.
CPC ..... *A47B 88/402* (2017.01); *A47B 88/43* (2017.01); *A47B 96/1441* (2013.01); *A47B 96/1466* (2013.01); *A47B 2088/401* (2017.01); *A47B 2210/0021* (2013.01); *A47B 2210/0024* (2013.01); *A47B 2210/0059* (2013.01)

(58) Field of Classification Search
CPC ... A47B 88/402; A47B 88/0455; A47B 88/43; A47B 88/044; A47B 55/02; A47B 96/1441; A47B 96/1466; A47B 2088/401; A47B 2210/0021; A47B 2210/0024; A47B 2210/0059
See application file for complete search history.

(56) References Cited

U.S. PATENT DOCUMENTS

| | | | | |
|---|---|---|---|---|
| 3,677,615 A * | 7/1972 | Hudson | A47B 88/43 384/20 |
| 5,407,084 A * | 4/1995 | Remmers | A47B 88/43 211/183 |
| 6,578,720 B1 * | 6/2003 | Wang | A47F 5/0093 211/126.15 |
| 8,960,822 B1 * | 2/2015 | Hsu | A47B 88/402 312/334.4 |
| 2011/0233162 A1 * | 9/2011 | Kundinger, Jr. | A47B 47/027 211/79 |

FOREIGN PATENT DOCUMENTS

| | | | |
|---|---|---|---|
| DE | 2716289 A1 * | 10/1978 | A47B 88/43 |
| EP | 1133939 A1 * | 9/2001 | A47B 88/43 |
| GB | 1022377 A * | 3/1966 | A47B 57/404 |

* cited by examiner

*Primary Examiner* — Andrew M Roersma
(74) *Attorney, Agent, or Firm* — Chun-Ming Shih; Lanway IPR Services

(57) ABSTRACT

A sliding rail structure for drawer of layered frame is mainly designed for being used to satisfying a requirement of allowing a bracket drawer to be disposed in a layered frame, and a sliding rail plate is buckled between horizontal rods arranged at two sides of the layered frame. The sliding rail plate is formed through a single metal piece being punched for formation, so that a main body thereof is formed as a U-like slot rack, two predetermined locations at a front end and a rear end of a top edge defined at a sealed side of the slot rack are punched for forming a pair of buckle hooks, buckle slots of each of the buckle hooks are designed in various specifications and statuses with respect to the specification and the status of the horizontal rod, thereby being in a non-arched polygonal status. Accordingly, the whole production cost can be lowered and better economic benefits can be provided.

3 Claims, 8 Drawing Sheets

SLIDING RAIL STRUCTURE FOR DRAWER OF LAYERED FRAME

BACKGROUND OF THE INVENTION

Field of the Invention

The present invention relates to a sliding rail structure for drawer of layered frame, in which a structure of an integrated sliding rail plate is designed with respect to the requirement of a layered frame being installed with a drawer, so that a stable buckling arrangement can be obtained, an operation of pulling or pushing a bracket drawer can be provided, and the production cost of the sliding rail plate can be effectively lowered for increasing the whole economic benefits.

Description of Related Art

In the design of a conventional layered frame, a vertical rod rack is provided to work with a plurality of horizontal connection rods arranged at two sides, and a reinforcing rod is disposed at the backside for assembling a basic structure of the layered frame, then a plurality of layer plates are selectively disposed on the layered frame, so as to structure the whole layered frame; with partition spaces of the layer frame, various objects can be stored or displayed, thus the space can be properly designed and utilized, and a plurality of the layered frames can be combined for expansion for increasing the storing and displaying space.

However, in this type of layered frame, because the layer plates can be served to allowing the objects to be stored and displayed, under a situation of lacking a fastening arrangement, the displayed objects may fall down due to an external force, meanwhile there is a limitation for the amounts and types of the stored or displayed objects; as such, for providing an advantage of being more practical in use, the applicant of the present invention has developed a sliding rail plate disposed on a horizontal rod at two sides of a layered frame, so that the layered frame is able to work with a bracket drawer, and advantages of being more practical and flexible in use are provided.

In the above-mentioned design of the sliding rail plate of the layered frame, a conventional art is to punch a metal piece to form a guiding slot rack main body in a substantial U-like shape, then buckle hooks are additionally fastened on an outer edge of a sealed side thereof, the plural buckle hooks can be used for being buckled on the horizontal rod at two sides of the layered frame, and the guiding slot rack main body is able to be relatively located at two sides of a storage space of the layered frame, thus convex rails at two sides defined on a top edge of the bracket drawer can be sleeved in the guiding slot racks, and an pushing and pulling operation can be performed for allowing the objects to be conveniently stored or taken out.

However, in the above-mentioned sliding rail plate, the guiding slot rack main body and the buckle hook are formed as two pieces, so that the whole production cost is increased, and the whole economic benefits are therefore affected; for solving the aforesaid problem, the applicant of the present invention has provided a plastic injection molding means for manufacturing an integrated sliding rail plate for lowering the production cost, but the structural strength and the service life are somehow sacrificed, and the sliding rail plate cannot really solve or satisfy requirements in industrial applications; as such, a novel design shall be provided for solving the above-mentioned disadvantages.

SUMMARY OF THE INVENTION

In view of the conventional non-integrated metal sliding rail plate requiring high production cost and the plastic-injection-molded integrated sliding rail plate having problems in structural strength and service life, the applicant of the present invention has devoted himself to design a sliding rail structure for drawer of layered frame.

One primary objective of the present invention is to provide a sliding rail structure for drawer of layered frame, in which a sliding rail plate is formed through a single metal piece being punched for formation, so that a main body thereof is formed as a U-like slot rack, two predetermined locations at a front end and a rear end of a top edge defined at a sealed side thereof are punched for forming a pair of buckle hooks, and distances between the pair of the buckle hooks and a front end par and a rear end part of the sliding rail plate are kept in a different status, so that when, the two sliding rail plates are buckled on the same horizontal rod and kept in an oppositely arranged status, and the buckle hooks thereof are able to be staggeringly disposed without being interfered with each other; moreover, buckle slots of each of the buckle hooks are designed in various specifications and statuses with respect to the horizontal rod being a round rod, a round pipe or a rectangular pipe, thus the buckle slots is formed in a non-arched polygonal status, thereby achieving a multiple-contact-point positioning effect while being buckled, meanwhile a base part of the main body of each of the buckle hooks being connected to the sliding rail plate is formed with a planar connecting surface, when the sliding rail plate carries the weights of the drawer, a better abutting strength and a stable buckling and fastening effect can be provided, thus the operation of pulling or pushing the drawer is allowed to be smoothly and stably performed Advantages achieved by the present invention are as follows. In the sliding rail structure for drawer of layered frame provided by the present invention, the single metal piece is punched for forming the sliding rail plate, so that the whole production cost can be lowered and better economic benefits can be provided, meanwhile, with the arrangement of the buckle hooks can be more stable, and the operation of pulling and pushing the drawer can be more smoothly and stably performed, thereby effectively increasing the practicability in operation.

DETAILED DESCRIPTION OF THE PREFERRED EMBODIMENT

Figure 1:
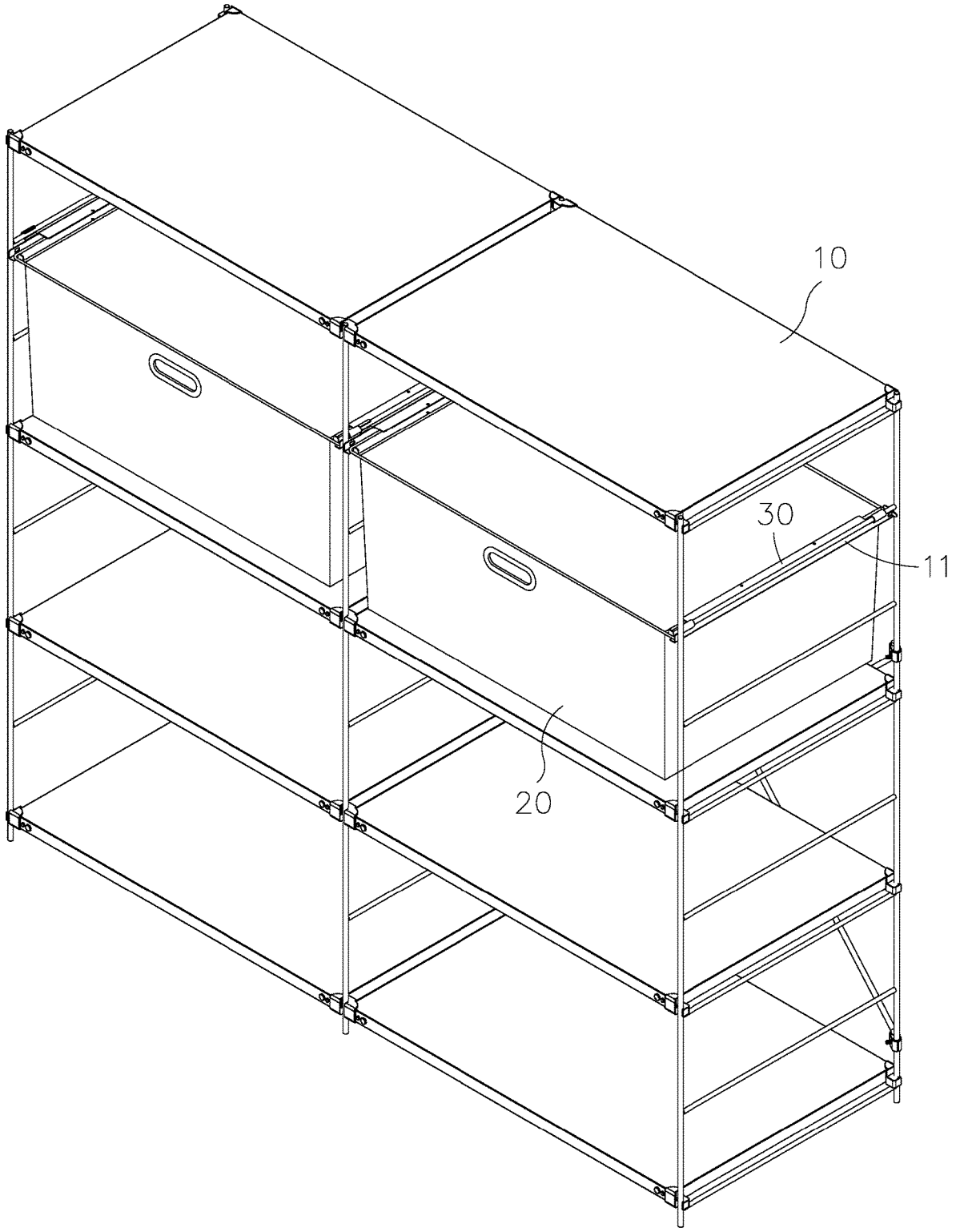
FIG. 1 is a schematic view showing an operating status according to the first embodiment of the present invention.
Figures 2, 3:
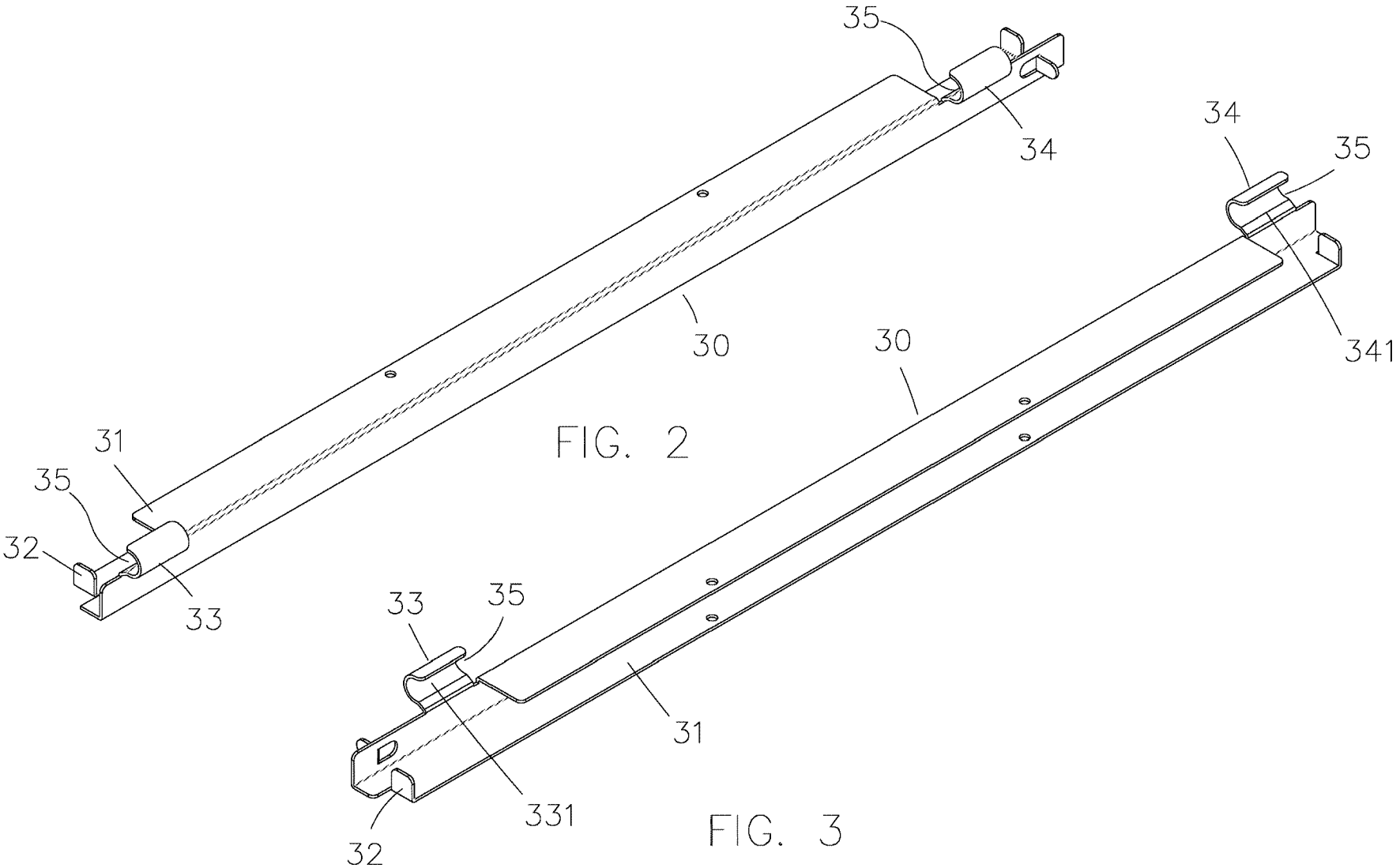
FIG. 2 is a schematic view showing the structure of according to the first embodiment of the present invention.
FIG. 3 is another schematic view showing the structure of according to the first embodiment of the present invention.
Figure 4:
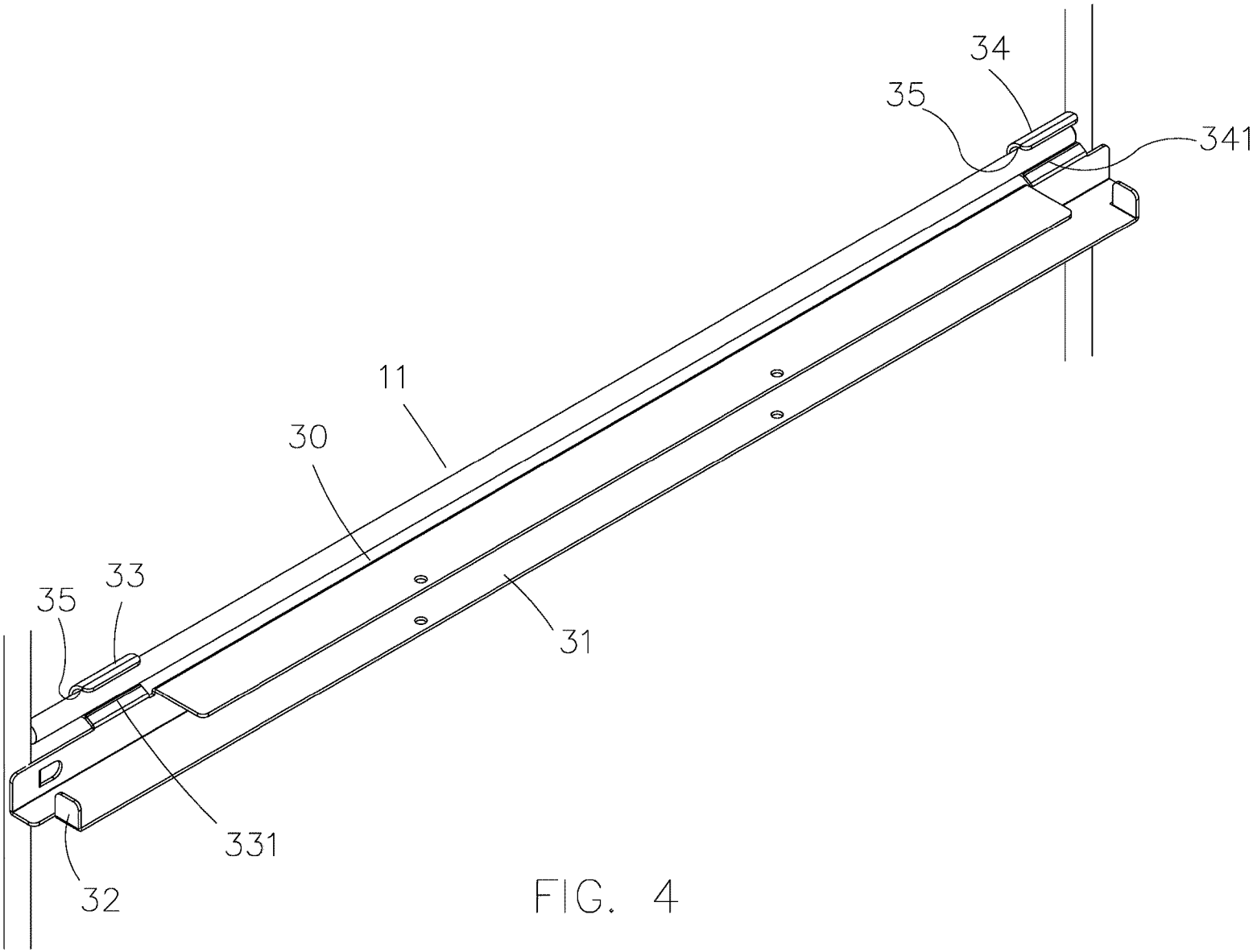
FIG. 4 is a schematic view showing the arrangement of according to the first embodiment of the present invention.
Figure 5:
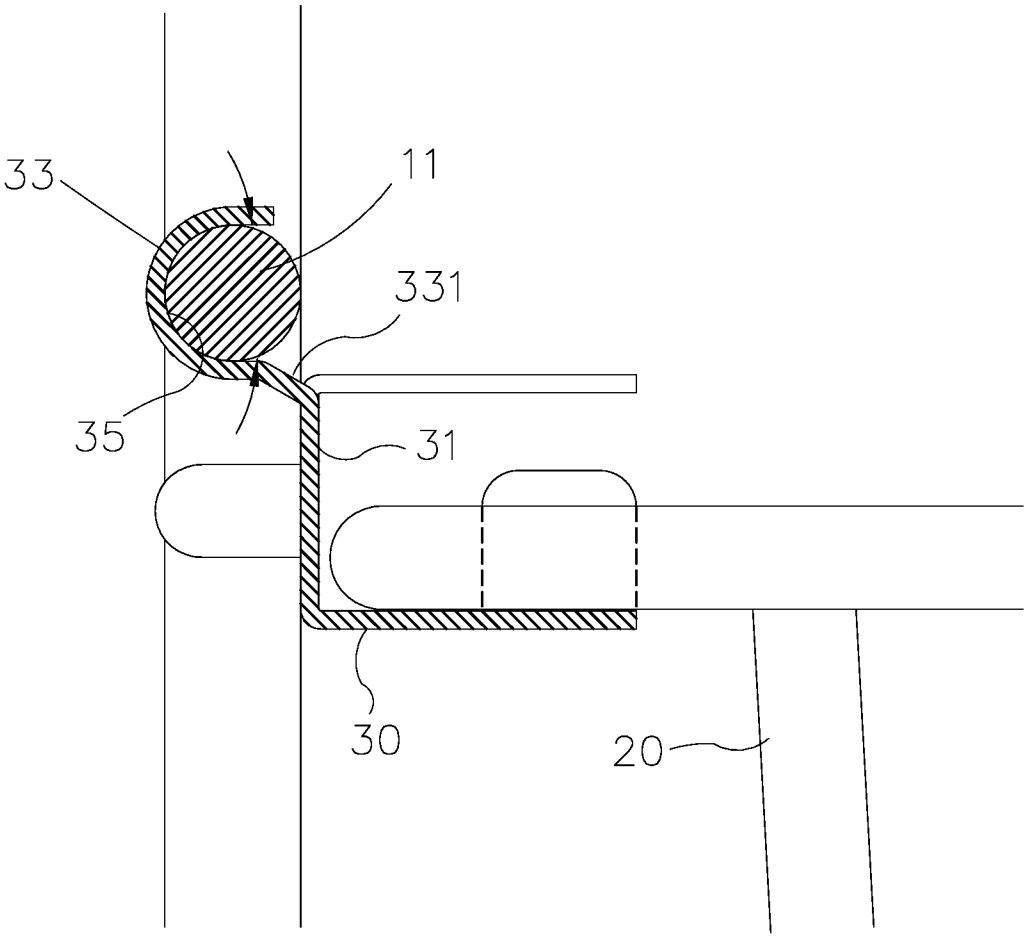
FIG. 5 is a schematic view showing the arranging relation of according to the first embodiment of the present invention.
Figure 6:
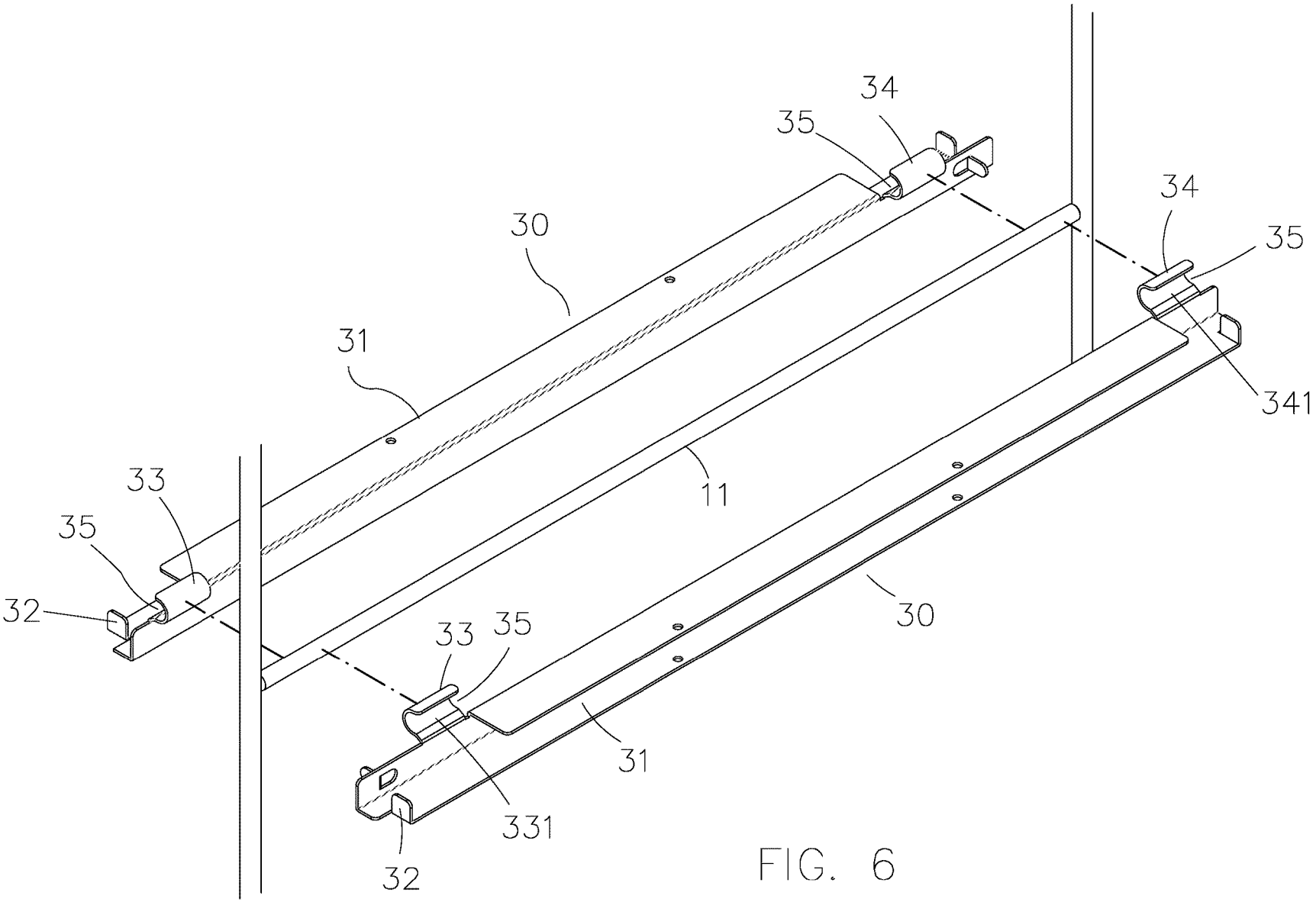
FIG. 6 is an exploded view showing a coupling arrangement of according to the first embodiment of the present invention.
Figure 7:
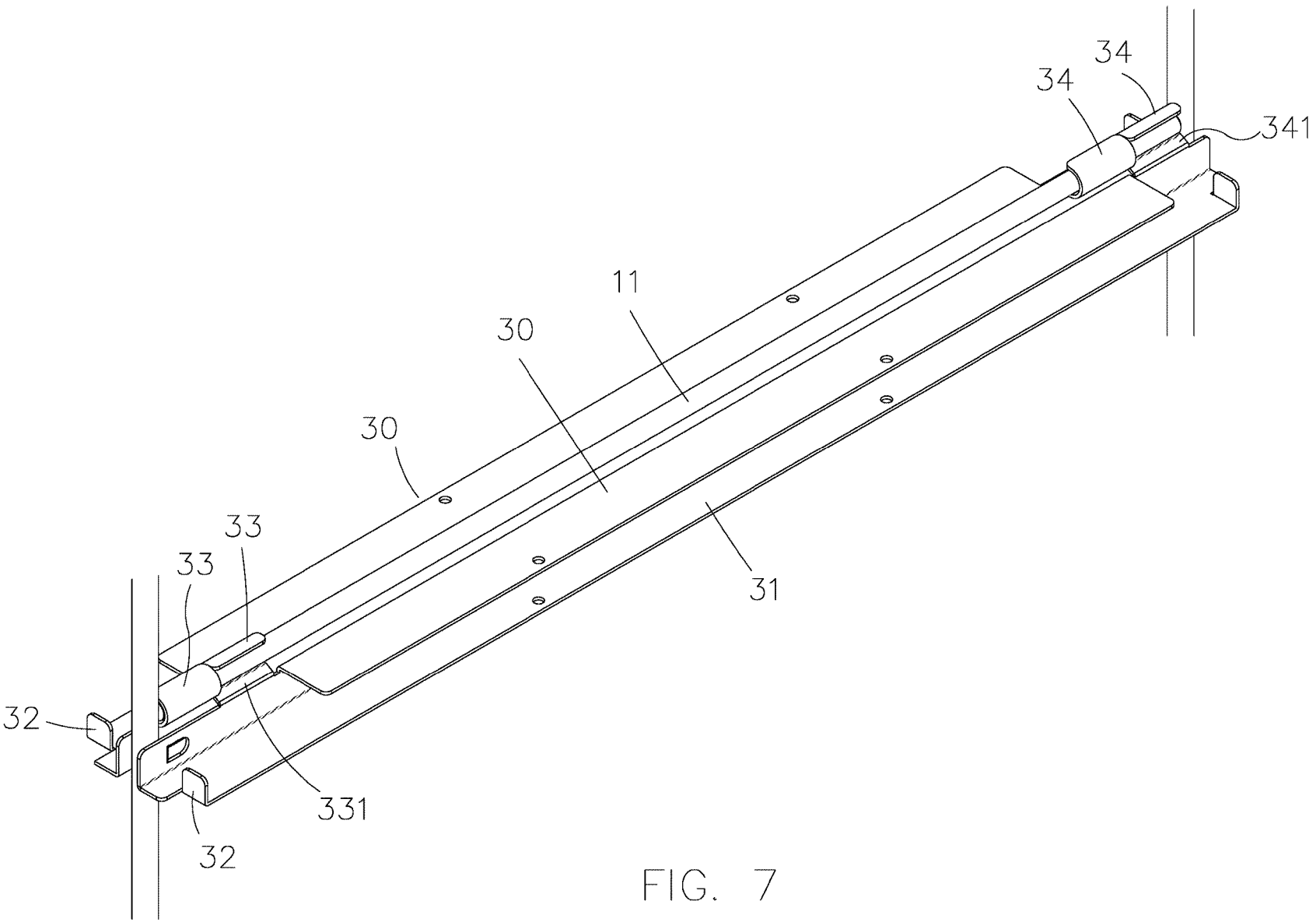
FIG. 7 is a schematic view showing the coupling arrangement of according to the first embodiment of the present invention.

Referring from FIG. 1 to FIG. 7, according to the first embodiment of the present invention, a sliding rail structure for drawer of layered frame is mainly designed for being used to satisfying a requirement of allowing a bracket drawer (20) to be disposed in a layered frame (10), and a sliding rail plate (30) is buckled between horizontal rod (11) arranged at two sides of the layered frame (10) so as to assemble a sliding rail for a drawer, the sliding rail plate (30) is formed through a single metal piece being punched for formation, so that a main body thereof is formed as a U-like slot rack (31), locations defined at a front end and a rear end of the slot rack (31) are respectively punched for forming a vertical stop plate (32) which is served as a pushing and pulling limitation for the bracket drawer (20), two predetermined locations at a front end and a rear end of a top edge defined at a sealed side of the slot rack (31) are punched for forming a pair of buckle hooks (33, 34), and distances between the pair of the buckle hooks (33, 34) and a front end par and a rear end part of the sliding rail plate (30) are kept in a different status, so that when an installation of the bracket drawer (20) of the layered frame (10) being arranged in a coupled or multiplied format is required, the two sliding rail plates (30, 30') can be buckled on the same horizontal rod (11) from two sides and kept in an oppositely arranged status, and the buckle hooks (33, 34) thereof are able to be staggeringly disposed without being interfered with each other; moreover, buckle slots (35) of each of the buckle hooks (33, 34) can be designed in various specifications and status with respect to the horizontal rod (11), thus a slot wall of each of the buckle slots (35) is formed in a non-arched polygonal status, thereby achieving a multiple-contact-point positioning effect while being buckled, meanwhile a base part of the main body of each of the buckle hooks (33, 34) being connected to the sliding rail plate (30) is formed with a planar connecting surface (331, 341), thereby providing a reinforcing effect, so that when the sliding rail plate (30) carries the weights of the bracket drawer (20) and stored objects therein, interfacing portions of the planar connecting surfaces (331, 341) and the buckle hooks (33, 34) able to be abutted against the horizontal rod (11), thereby obtaining a better abutting strength and enhancing the stability defined while the sliding rail plate (30) being buckled, and situations of loosening or falling can be prevented, so that the operation of pulling or pushing the bracket drawer (20) can be smoothly and stably performed.

Figure 8:
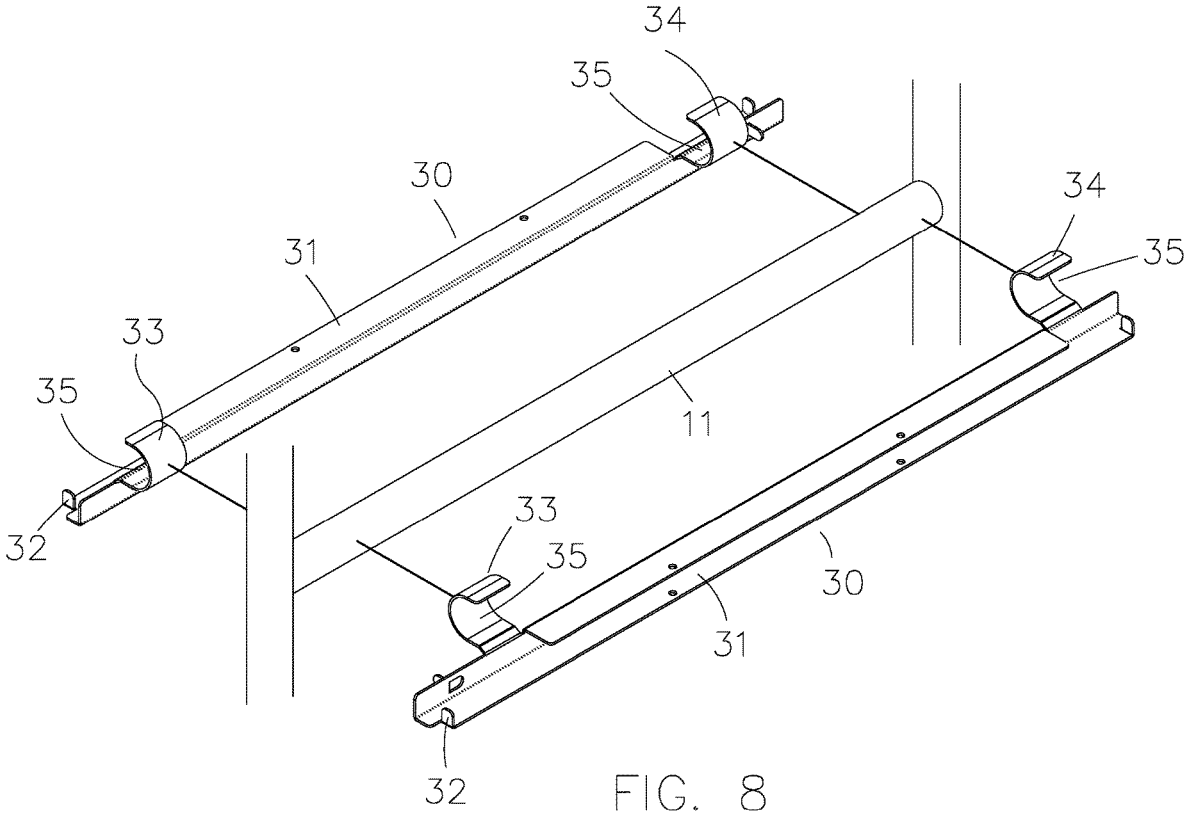
FIG. 8 is a schematic view showing the structure of according to the second embodiment of the present invention.
Figure 9:
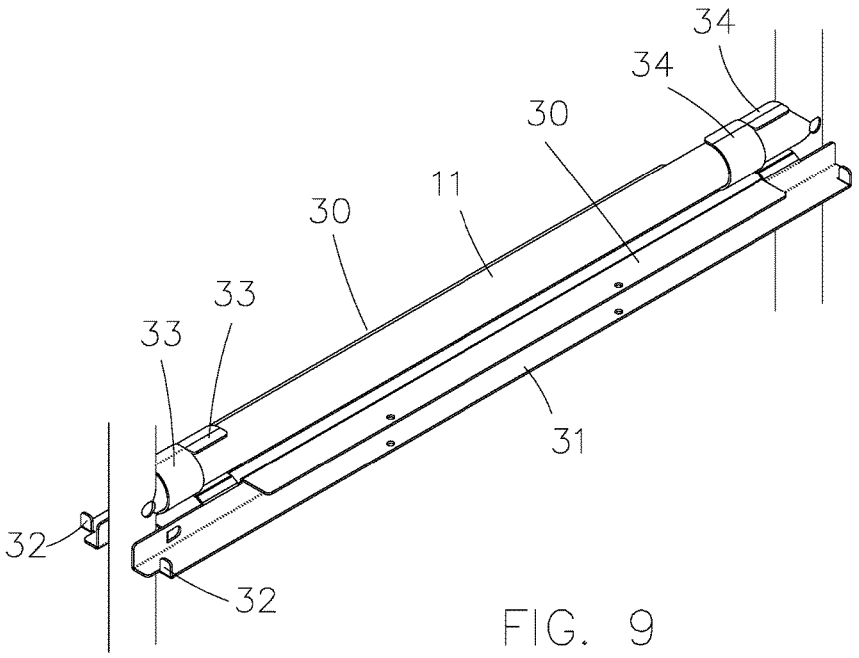
FIG. 9 is a schematic view showing the arrangement of according to the second embodiment of the present invention.
Figure 10:
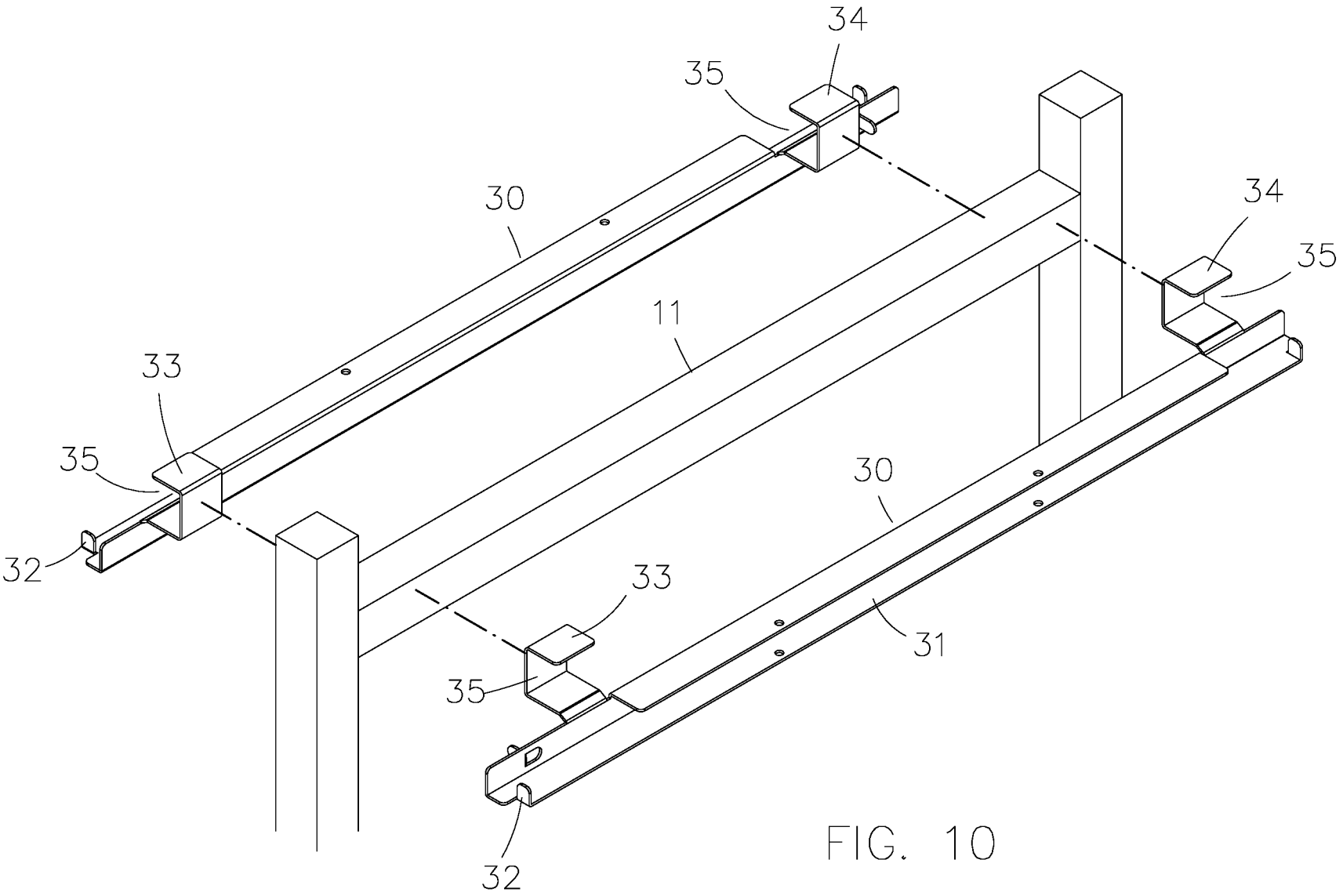
FIG. 10 is a schematic view showing the structure of according to the third embodiment of the present invention.

Please refer from FIG. 8 to FIG. 10, according to the first embodiment of the sliding rail structure for drawer of layered frame provided by the present invention, a round horizontal rod is adopted for illustrations, when a round pipe (as shown in FIG. 8 and FIG. 9) or a rectangular pipe (as show in FIG. 10) is adopted as the horizontal rod (11) of the layered frame (10), when the sliding rail plate (30) of the present invention is manufactured, besides the single metal piece is punched for forming the U-shaped slot rack (31) and the stop plates (32) at the front end and the rear end, the buckle slots (35) of the buckle hooks (33, 34) at the two predetermined locations at the front end and the rear end of the top edge defined at the sealed side can be formed in different specifications and statuses, in other words for matching with the round-pipe horizontal rod (11), the specifications of the buckle slots (35) of the buckle hooks (33, 34) of the sliding rail plate (30) are required to be enlarged, the slot wall thereof is formed in the non-arched polygonal status, thereby achieving a stable hooking and hanging effect while being buckled on the round-pipe horizontal rod (11), as shown in FIG. 8 and FIG. 9; when the rectangular-pipe horizontal rod (11) is adopted, the buckle slots (35) of the buckle hooks (33, 34) of the sliding rail plate (30) are designed to be in a rectangular status and the specifications thereof are also enlarged, so that the sliding rail plate (30) can be stably buckled on the rectangular-pipe horizontal rod (11), as shown in FIG. 10; as such, when the sliding rail plate (30) of the present invention is applied in an industrial application, as long as the horizontal rod (11) is disposed at two sides of the layered frame (10), the sliding rail plate (30) with a matched status can be buckled and hanged on the horizontal rod (11) with respect to the different statuses of round-rod, round-pipe or rectangular-pipe, thereby forming the sliding rail for drawer; accordingly, the layer frame (10) is able to work with the bracket drawer (20) for allowing objected to be stored or displayed.

Based on what has been disclosed above, in the sliding rail structure for drawer of layered frame provided by the present invention, the single metal piece is punched for forming the sliding rail plate, so that the whole production cost can be lowered, and the structural strength can also be increased, meanwhile, with the arrangement of the buckle hooks, a smooth operation without being interfered can be provided when the buckle hooks of the sliding rail of the drawer of the layered frame is arranged in the coupled format; and with the design of different specifications and statuses of the buckle hooks of the sliding rail plate, the present invention can be applied in various types of layered frame. Accordingly, the present invention is novel and more practical in use comparing to prior art.

Based on what has been disclosed above, with the improved design of the sliding rail structure for drawer of layered frame provided by the present invention, an advantages of being more practical in use is achieved through the layered frame working with the bracket drawer, so that the whole production cost can be effectively lowered, meanwhile the operation can be more practical, and capable of working with different types of layered frame by the altered designs, thus disadvantages existed in the conventional structure can be effectively solved. Accordingly, the present invention is novel and more practical in use comparing to prior art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A sliding rail structure disposing a bracket drawer in a layered frame, the sliding rail structure comprising a sliding rail plate buckled to one of two horizontal rods respectively arranged at two sides of the layered frame, thereby forming a sliding rail for the bracket drawer, wherein:

the sliding rail plate is formed as a single metal piece that is punched for formation, so that a main body thereof is formed as a U-shaped slot rack, locations defined at a front end and a rear end of the U-shaped slot rack are respectively punched to form a vertical stop plate which is used as a pushing and pulling limitation for the bracket drawer, two predetermined locations at a front end and a rear end of a top edge defined at a solid side of the U-shaped slot rack are punched to form a pair of buckle hooks, buckle slots of the buckle hooks are in a non-arched polygonal configuration with respect to the horizontal rod, a base part of a main body of each of the buckle hooks is formed with a planar connecting surface to provide a structural reinforcing effect, and when the sliding rail plate is buckled to the horizontal rod, interfacing portions of the planar connecting surfaces and the buckle hooks are abutted against the horizontal rod, thereby obtaining enhanced abutting strength and enhancing stability of the sliding rail plate.

2. The sliding rail structure as claimed in claim 1, wherein a distance between a front end of the sliding rail plate and a first of the buckle hooks is different than a distance between a rear end of the sliding rail plate and a second of the buckle hooks, so that when two said sliding rail plates are buckled on a single said horizontal rod, the two sliding rail plates are able to be buckled on the single said horizontal rod from two sides thereof and kept in an oppositely arranged status, and the buckle hooks of the two sliding rail plates are able to be disposed in a staggered manner without being interfered with each other.

3. The sliding rail structure as claimed in claim 1, wherein the buckle slots of the pair of buckle hooks are shaped to correspond to the horizontal rod being one of a round rod, a round pipe or a rectangular pipe.

* * * * *